US006777878B2

(12) United States Patent
Berlinghof et al.

(10) Patent No.: US 6,777,878 B2
(45) Date of Patent: Aug. 17, 2004

(54) DIELECTRIC BARRIER DISCHARGE LAMP HAVING AN IGNITION MEANS

(75) Inventors: Werner Berlinghof, Herbrechtingen (DE); Gerhard Döll, Ulm (DE); Wolfgang Kumpf, Herbrechtingen (DE); Gerwin Thiel, Eichenau (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 10/186,730

(22) Filed: Jul. 2, 2002

(65) Prior Publication Data

US 2003/0011321 A1 Jan. 16, 2003

(30) Foreign Application Priority Data

Jul. 10, 2001 (DE) ..... 101 33 326

(51) Int. Cl.[7] ..... H01J 13/46; H01J 17/18

(52) U.S. Cl. ..... 315/58; 315/248; 315/246; 313/623; 313/624; 313/39

(58) Field of Search ..... 315/56, 248, 246, 315/46, 97, 363, 58–62; 313/623, 624, 625, 622, 39, 326, 607, 606, 495, 141, 142, 246, 251, 335, 283, 238

(56) References Cited

U.S. PATENT DOCUMENTS

| | | | | |
|---|---|---|---|---|
| 5,432,398 A | | 7/1995 | Kogelschatz | 313/25 |
| 5,604,410 A | | 2/1997 | Vollkommer et al. | 315/246 |
| 6,097,155 A | | 8/2000 | Vollkommer et al. | 315/58 |
| 6,172,467 B1 | | 1/2001 | Vollkommer et al. | 315/246 |
| 6,310,442 B1 | * | 10/2001 | Vollkommer et al. | 315/246 |
| 6,323,600 B1 | | 11/2001 | Statnic et al. | 315/209 R |
| 6,388,391 B2 | * | 5/2002 | Thiel et al. | 315/246 |
| 2001/0013759 A1 | * | 8/2001 | Thiel et al. | 315/246 |
| 2002/0163306 A1 | * | 11/2002 | Berlinghof et al. | 313/625 |

FOREIGN PATENT DOCUMENTS

| | | | |
|---|---|---|---|
| DE | 100 48 410 | 9/2000 | |
| DE | 100 48 410 A1 | 4/2002 | H01J/65/04 |

* cited by examiner

*Primary Examiner*—Tuyet T. Vo
(74) *Attorney, Agent, or Firm*—Robert F. Clark

(57) ABSTRACT

A dielectric barrier discharge lamp has elongated electrodes (3) that are arranged on the inside of the wall of the discharge vessel (2) and are covered by a dielectric layer (4). Arranged on the outside of the wall of the discharge vessel (2) is an electrically conductive means (8) that is limited with reference to the longitudinal axis to a subregion (B) of the discharge vessel wall, for example a metal ring. The startability of the dielectric barrier discharge lamp when first being started or after long operational pauses is improved thereby.

10 Claims, 2 Drawing Sheets

DIELECTRIC BARRIER DISCHARGE LAMP HAVING AN IGNITION MEANS

TECHNICAL FIELD

The invention relates to a dielectric barrier discharge lamp and a lighting system having such a lamp and an electric power supply unit.

The term "dielectric barrier discharge lamp" in this case covers sources of electromagnetic radiation based on dielectrically impeded gas discharges. The spectrum of the radiation emitted by the gas discharge can in this case comprise both the visible region and the UV (ultraviolet)/VUV (vacuum ultraviolet) region and the IR (infrared) region. Furthermore, it is also possible to provide a fluorescent layer for converting invisible radiation into visible radiation (light).

The discharge vessel is usually filled with a rare gas, for example xenon, or a gas mixture. What are termed excimers are formed during the gas discharge, which is preferably operated by the use of a pulsed operating method described in U.S. Pat. No. 5,604,410. Excimers are excited molecules, for example $Xe_2^*$, which emit electromagnetic radiation upon return to the generally unbonded ground state. In the case of $Xe_2^*$, the maximum of the molecular band radiation is approximately 172 nm.

A dielectric barrier discharge lamp necessarily has at least one so-called dielectrically impeded electrode. A dielectrically impeded electrode is separated from the interior of the discharge vessel by the use of a dielectric barrier. By way of example, this dielectric barrier may be designed as a dielectric layer which covers the electrode, or formed by the discharge vessel of the lamp itself, specifically if the electrode is arranged on the outer wall of the discharge vessel.

Because of the dielectric barrier, the operation of such lamps requires a time-variable voltage between the electrodes, for example a sinusoidal AC voltage or pulsed voltage as disclosed in U.S. Pat. No. 5,604,410.

In the case of dielectric barrier discharge lamps, the first ignition or ignition after lengthy operating pauses is frequently difficult, in particular after lengthy storage of the lamps in the dark. As a rule, a substantially higher voltage is required than in normal operation. Moreover, upon first ignition a filamentary partial discharge frequently occurs which is undesired, since its useful radiation emission is inefficient by comparison with that of the discharge form disclosed in U.S. Pat. No. 5,604,410.

BACKGROUND ART

U.S. Pat. No. 6,097,155 has already disclosed a dielectric barrier discharge lamp having an elongated discharge vessel and having elongated dielectrically impeded electrodes arranged on the inside of the discharge vessel wall along the longitudinal axis.

A high-power radiator based on dielectrically impeded discharge is disclosed in U.S. Pat. No. 5,432,398 in the form of a coaxial double-tube arrangement. An outer electrode in the form of a wire mesh extends over the entire circumference of the outer quartz tube. A helical inner electrode is pushed into the inner quartz tube. The interior of the inner quartz tube is filled with a cooling liquid that has a high dielectric constant and, in addition to serving the purpose of cooling, also serves to couple the inner electrode to the inner quartz tube. A multiplicity of discharge channels form between the electrodes upon the application of an AC voltage in the space between the two tubes, the discharge space. For the purpose of improving the ignition behavior during the first ignition or after lengthy operational pauses, means are provided that force an initial ignition by means of local field distortion or field prominence at a point in the discharge space. The reliable ignition of the entire discharge volume is then forced by the UV radiation produced in this case and the charge carriers of this local discharge. The following are disclosed as suitable means for the field distortion: a dent in the inner or outer tube that reaches approximately up to half the gap width to the respective other tube; a sphere of dielectric material in the discharge space; a quartz droplet fused onto the inner surface of the outer tube or the outer surface of the inner tube.

SUMMARY OF THE INVENTION

It is the object of the present invention to provide a dielectrically impeded barrier discharge lamp which demonstrates improved ignition behavior.

This object is achieved by means of a dielectric barrier discharge lamp having an elongated discharge vessel defining a longitudinal axis, and having elongated dielectrically impeded electrodes arranged on the discharge vessel wall along this longitudinal axis, and having at least one electrically conductive means that extends with reference to the longitudinal axis only over a subregion of the discharge vessel wall and that is arranged on the discharge vessel wall to support the ignition of the dielectrically impeded discharge.

Also claimed is a lighting system having the above-named dielectric barrier discharge lamp and having a voltage source with two poles which can provide a pulsed-voltage sequence at these two poles, electrodes being connected to the two poles.

The dielectric barrier discharge lamp according to the invention has at least one electrically conductive means for supporting the ignition of the dielectrically impeded discharge that is arranged on the discharge vessel wall and extends with reference to the longitudinal axis only over a subregion of the discharge vessel wall.

It is assumed according to the present state of knowledge—without hereby intending to fix the theoretical interpretation—that this means permits an initial ignition between this means and at least one dielectrically impeded electrode more specifically at voltages that are already lower than without this means. This initial ignition then effects an ignition of the actual discharge between the dielectric electrodes. In addition, the means greatly reduces the probability of the undesired occurrence, mentioned at the beginning, of the filamentary partial discharge.

In a preferred embodiment, the dielectric barrier discharge lamp has inner electrodes, since this embodiment in accordance with U.S. Pat. No. 6,097,155 has proved to be particularly efficient. In this case, the dielectrically impeded electrodes are implemented by means of elongated electrodes that are arranged on the inside of the wall of the discharge vessel and are covered by a dielectric layer. The electrically conductive means is arranged on the outside of the wall of the discharge vessel.

This embodiment has the additional advantage that the means can be applied from the outside, that is to say after fabrication of the discharge vessel. Suitable in this case as electrically conductive means is, inter alia, a ring or part of a ring, in particular made from metal, which can also be mounted subsequently on the elongated discharge vessel, particularly in the form of a circular tube. Moreover, it is also possible to conceive further refinement of the means which fulfill the above-named purpose, for example a filament or spring tightly wound around the discharge vessel. Finally, a differently shaped planar refinement of the means is also possible in principle, for example a metal sheet of rectangular, round or oval shape, although further arrangements for fastening the means on the wall of the discharge vessel are to be taken in some circumstances. This can be avoided when the means is implemented by a corresponding conductive coating, for example a metal solder layer.

The width of the means along the longitudinal axis of the discharge vessel is typically between approximately 1 mm and a few 10 mm, particularly between 3 mm and 15 mm. It has proved that this is sufficient as a rule for reliable ignition, on the one hand, and that the light emitted by the lamp is still shaded to a relatively small extent, on the other hand. Moreover, the means is preferably arranged at one end of the discharge vessel. It has proved to be advantageous in this case when the means overlaps one end of the elongated electrodes. An overlap of a few mm, in particular approximately 1 mm, is already sufficient. However, the means can also overlap the elongated electrodes over its entire width.

In the case of very long lamps, it can possibly also be advantageous to provide two means, for example one at each end of the lamp, or else several means distributed along the lamp axis, in order to ensure rapid and uniform ignition of the entire lamp.

In a further preferred embodiment, the lamp has a base at at least one end, the means being integrated in the base.

Although the electrically conductive means can also be at a floating electric potential, it has proved to be favorable when the means is connected to ground potential, preferably to the plane potential of the voltage source supplying the lamp. The connection to plane potential has the advantage that defined voltage conditions are set up between the means and electrodes.

In order to make up a complete lighting system, the electrodes of the dielectric barrier discharge lamp according to the invention are connected to the associated poles of a voltage source. The means is connected to constant potential, with reference to the time-variable voltage at the poles of the voltage source. The voltage source is preferably designed in such a way that it can provide a pulsed-voltage sequence at its poles. Reference is made to U.S. Pat. No. 6,323,600 for further details on this. It is particularly preferred to design the voltage source in such a way that the voltage source can provide a symmetrical pulsed-voltage sequence with reference to its plane potential, the means being connected to the plane potential. The use of a symmetrical voltage has the advantage here, inter alia, that no undesired capacitive currents flow via the means to the ground line.

BRIEF DESCRIPTION OF THE DRAWINGS

The aim below is to explain the invention in more detail with the aid of exemplary embodiments. In the drawing.

BEST MODE FOR CARRYING OUT THE INVENTION

Figure 1:
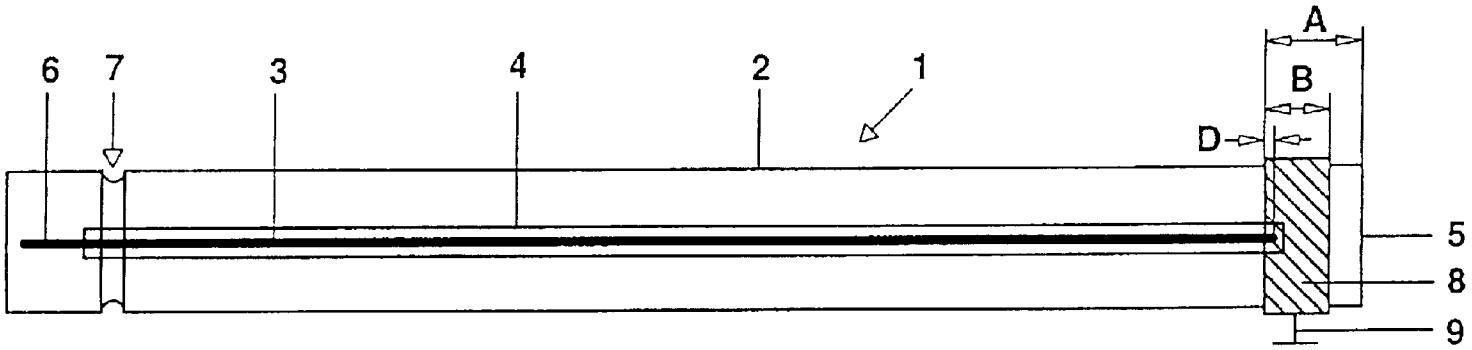
FIG. 1 shows a schematic plan view of a first exemplary embodiment.
Figure 3:
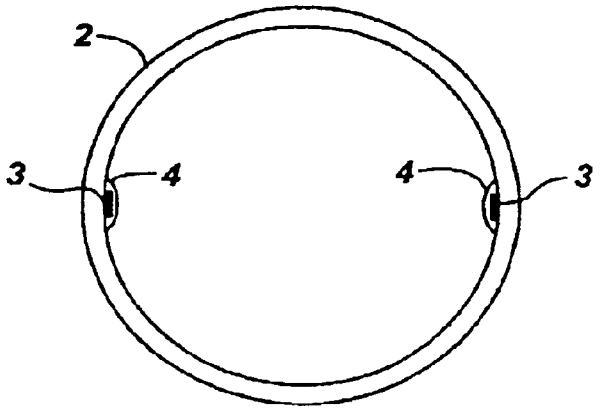
FIG. 3 is a cross-sectional illustration through a central region of the first exemplary embodiment shown in FIG. 1.

FIG. 1 shows a tubular fluorescent lamp 1. The lamp 1 essentially comprises a tubular discharge vessel 2 made from soda-lime glass with a circular cross section, as well as two strip-shaped electrodes 3 (the second electrode is covered and therefore cannot be seen), which are applied, arranged parallel to the tube longitudinal axis and diametrically relative to one another, to the inside of the wall of the discharge vessel 2. Each of the inner electrodes 3 is covered by a dielectric barrier 4 made from glass solder. Furthermore, the inside of the wall of the discharge vessel is covered by a fluorescent layer (not shown for reasons of presentation). FIG. 3 is a cross-sectional illustration of a central region of the tubular discharge vessel 2 showing the strip-shaped electrodes 3 covered by dielectric barrier 4.

A first end of the discharge vessel 2 is sealed by means of butt fusion 5. The two electrodes 3 end at a short distance A=8 mm in front of this fusion 5. The electrodes 3 are guided to the outside in a gastight fashion through the other end of the discharge vessel 2, and merge there in each case into an external supply lead 6. The second end of the discharge vessel 2 is sealed by means of a plate-shaped sealing element (not detectable in this illustration). To this end, the edge of the plate-shaped sealing element is fused with a restriction 7 of the discharge vessel 2. For further details on this, reference is made to WO 02/27747.

Arranged at the first end of the discharge vessel 2 is a metal ring 8 of width B=5 mm—viewed in the direction of the longitudinal axis of the discharge vessel 2—on the outside of the wall of the discharge vessel 2. Moreover, the metal ring 8 is positioned such that it covers the end, facing the first end of the discharge vessel 2, of the electrodes 3 by the overlap D=1 mm. The metal ring 8 is illustrated transparently in FIG. 1 for the purpose of better understanding of the conditions.

The lamp 1 is provided for a pulsed mode of operation in accordance with the already mentioned U.S. Pat. No. 5,604,410. For this reason, the two outer supply leads 6 of the dielectric barrier discharge lamp 1 are connected to the two poles of a voltage source (not illustrated). The voltage source is designed to provide at its two poles a pulsed-voltage sequence that is symmetrical with reference to a plane potential. Reference is made with regard to such a voltage source to U.S. Pat. No. 6,172,467. The metal ring 8 is connected via a connection 9 to the plane potential of the voltage source. Consequently, the metal ring 8 acts as a means for improving the ignition behavior, as a result of which markedly lower voltages are required for igniting the lamp after long operational pauses than without the ring.

Figure 2:
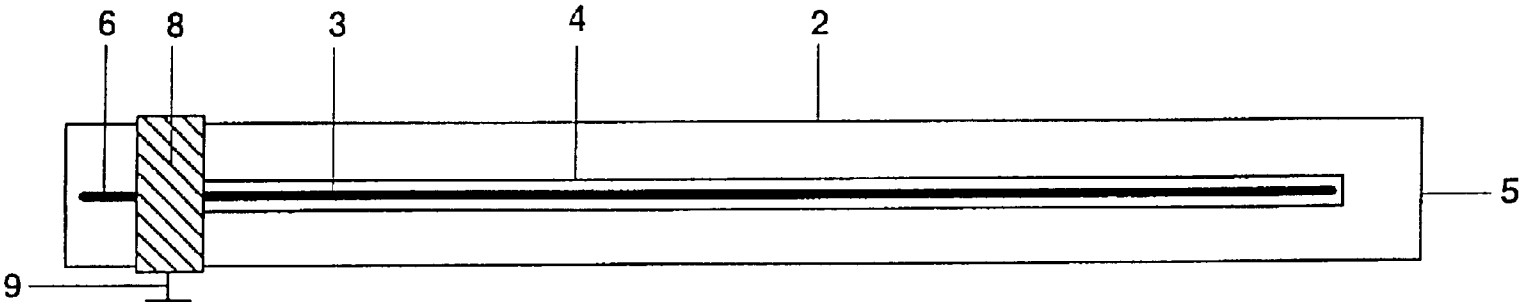
FIG. 2 shows a schematic plan view of a second exemplary embodiment.

A variant of the lamp from FIG. 1 is illustrated in FIG. 2. Here, the same features are provided with the same reference numerals. The variant in FIG. 1 differs in that the metal ring 8 is pushed over the second end of the discharge vessel 2, and is arranged over the constriction 7 (covered here and therefore not visible). The advantage of this variant consists in that the connection 9 can be guided to the voltage source at the second end of the lamp in common with the feed lines (not illustrated) for the supply leads 6 of the electrodes 3. Moreover, it has been proved that in this variant the probability of the undesired occurrence, mentioned in the beginning, of the filamentary partial discharge is reduced in a particularly marked fashion. A connection to a defined electric potential (plane or ground potential) is not mandatory in this case. It is probable in each case that the metal ring 8 over the constriction has a favorable influence on the electric field in the region of the lead-through of the supply leads 6 into the interior of the discharge vessel 2.

In a development, the lamp is provided with a base (not illustrated) in which the metal ring is integrated.

What is claimed is:

1. A dielectric barrier discharge lamp, comprising:

an elongated discharge vessel containing a gaseous fill, the discharge vessel having a wall and a longitudinal axis;

dielectrically impeded electrodes arranged on the inside of the wall and extending along the longitudinal axis, the electrodes being connectable to a voltage source; and, a single electrically conductive ignition means arranged on the outside of the wall at an end of the discharge vessel, the ignition means being connectable to a ground potential.

2. The lamp according to claim 1 wherein the ground potential is a plane potential of the voltage source.

3. The lamp according to claim 1 wherein the discharge vessel is a circular tube and the ignition means is a ring or part of a ring.

4. The lamp according to claim 3 wherein the electrodes are strip-shaped and arranged parallel to the longitudinal axis of the discharge vessel.

5. The lamp according to claim 1 wherein the ignition means overlaps at least a portion of the electrodes.

6. The lamp according to claim 5 wherein the overlap is approximately 1 mm.

7. The lamp according to claim 5 wherein the discharge vessel has a circular tube shape and the ignition means is a ring or part of a ring.

8. The lamp according to claim 7 wherein the lamp has only two electrodes which are disposed diametrically relative to one another.

9. A dielectric barrier discharge lamp, comprising:

an elongated discharge vessel containing a gaseous till, the discharge vessel having circular tube shape, a wall, and a longitudinal axis;

two strip-shaped dielectrically impeded electrodes diametrically arranged on the inside of the wall and extending along and parallel to the longitudinal axis, the electrodes being connectable to a voltage source; and, an electrically conductive ignition means arranged on the outside of the wall at one end of the discharge vessel and overlapping at least part of the electrodes by approximately 1 mm, the ignition means being connectable to a ground potential and comprising a ring or part of a ring.

10. The lamp according to claim 9 wherein the ground potential is a plane potential of the voltage source.

* * * * *